US005586951A

United States Patent [19]

Sugiura

[11] Patent Number: 5,586,951

[45] Date of Patent: Dec. 24, 1996

[54] GOLF BALL

[75] Inventor: Michihiko Sugiura, Hiratsuka, Japan

[73] Assignee: The Yokohama Rubber Co., Ltd., Tokyo, Japan

[21] Appl. No.: 503,923

[22] Filed: Jul. 19, 1995

[30] Foreign Application Priority Data

Jul. 21, 1994 [JP] Japan ..... 6-169704

[51] Int. Cl.[6] ..... A63B 37/14

[52] U.S. Cl. ..... 473/379; 473/381; 473/384

[58] Field of Search ..... 273/232; 473/378, 473/379, 381, 383, 384

[56] References Cited

U.S. PATENT DOCUMENTS

| | | | |
|---|---|---|---|
| 4,886,277 | 12/1989 | Markey | 273/232 |
| 4,960,282 | 10/1990 | Shaw | 273/232 |
| 5,080,367 | 1/1992 | Lynch et al. | 273/232 |
| 5,092,604 | 3/1992 | Oka | 273/232 |
| 5,253,872 | 10/1993 | Lemons et al. | 273/232 |

*Primary Examiner*—George J. Marlo

*Attorney, Agent, or Firm*—Finnegan, Henderson, Farabow, Garrett & Dunner, L.L.P.

[57] ABSTRACT

A golf ball includes a substantially spherical surface containing a plurality of dimples of differing diameter. Twelve spherical regular pentagons and twenty spherical regular triangles are arranged on the spherical surface in a manner corresponding to a dodecaicosahedron (12–20 hedron). Each pentagon shares a same asymmetrical dimple pattern such that each of five sides of each pentagon have a dimple pattern that differs from a dimple pattern on four other sides, and all of the pentagons share the same five differing side patterns. Six great circle paths are arranged about the spherical surface, each great circle path being bounded on one side by a series of five adjacent pentagons, one of which is a reference pentagon, and the other four of which are respectively and angularly displaced at angles of 72°, 288°, 144° and 216° with respect to the reference pentagon. A sequence of angular pentagon displacement of the series is consistent along all six great circle paths.

13 Claims, 3 Drawing Sheets

GOLF BALL

BACKGROUND OF THE INVENTION

This invention relates to a golf ball having a characteristic arrangement of dimples. More particularly, the present invention relates to a golf ball which can secure nearly the same carry or flying distance regardless of the orientation of the ball when hit and which can make it possible to more freely arrange the dimples.

When the dimples are arranged on a spherical surface of a golf ball, the spherical surface is divided into spherical polygons by assuming polyhedrons inscribing the sphere and projecting each polygon constituting the polyhedron on the spherical surface. The dimple arrangement is designed on the basis of these spherical polygons. The polyhedrons may include regular polyhedrons such as a regular octahedron, a regular dodecahedron, a regular icosahedron, etc., and quasi-regular polyhedrons such as a dodeca-icosahedraon (12–20 hedron), a cubic octahedron, etc.

The dimples arranged in this way are generally disposed with a lot of symmetry lines so that the ball has the same carrying properties (flying distance) how the ball is set on the tee (or how the ball lies). This property is sometimes referred to as aerodynamical uniformity.

An example of a prior art golf ball is shown in FIG. 6. In this golf ball, each polygon constituting a 12–20 hedron is projected on the spherical surface 11 and dimples 12 are arranged thereon. The spherical surface 11 is divided into twelve spherical regular pentagons X and twenty spherical regular triangles Y corresponding to the facets of the 12–20 hedron. A plurality of dimples 12 are arranged in each of these spherical regular pentagons X and triangles Y. Six great circle paths (the center of which coincides with the core center of the golf ball) Z which coincide with the dividing lines are disposed on the golf ball. Each of the spherical regular pentagons X and triangles Y respectively employ the same dimple pattern.

In the golf ball of FIG. 6 the dimple pattern is the same when viewed from any side of each spherical regular pentagon X or each spherical regular triangle Y. In other words, in the case of the spherical regular pentagon, the dimple pattern has five symmetry lines passing through the angles of the spherical regular pentagon, respectively, and in the case of the spherical regular triangle, the dimple pattern has three symmetry lines passing through the angles of the spherical regular triangle, respectively.

Accordingly, the dimples arranged on the spherical surface of the golf ball have high symmetricalness, and make it possible to secure generally the same carry irrespective of the setting method of the golf ball. On the contrary, because the limitation exists in that the dimple patterns must be disposed symmetrically, the problem of poor freedom of design of the dimple arrangement is posed.

SUMMARY OF THE INVENTION

It is an object of the present invention to provide a golf ball which can improve design freedom of the dimple arrangement while making it possible to secure almost the same carry regardless of how the ball is set on the tee.

In a golf ball the spherical surface of which is divided into twelve spherical regular pentagons and twenty spherical regular triangles corresponding to the facets of a 12–20 hedron having a plurality of dimples disposed therein and has six great circle paths. The golf ball according to the present invention for accomplishing the object described above is characterized in that a dimple pattern having the same arrangement is disposed inside each of the spherical regular pentagons, the dimple pattern is constituted in such a manner that all the dimple arrangements thereof are different from each other when viewed from the direction of each side of the spherical regular pentagon. In addition, the dimple patterns disposed in the five spherical regular pentagons aligned along one side of each great circle path are different from each other in the same sequence with respect to each of the great circle paths.

According to another aspect of the invention, a golf ball has a spherical surface which is divided into eight spherical regular triangles and six spherical regular rectangles corresponding to the facets of a cubic octahedron. The ball has a plurality of dimples arranged thereon and has four great circle paths. A dimple pattern having the same arrangement is formed in each of the spherical regular triangles, the dimple pattern being constituted in such a manner that all the dimple arrangements thereof are different from each other when viewed from the direction of each side of the spherical regular triangle. In addition, the directions of the dimple patterns disposed in the three spherical regular triangles aligned on one side along each of the great circle paths are different from each other in the same sequence with respect to each of the great circle paths.

In the case of the golf ball whose spherical surface is so divided as to correspond to the facets of the 12–20 hedron, the dimple arrangements are all entirely different from each other when viewed from the direction of any side of the spherical regular pentagon. When the dimple pattern is disposed in each of the five spherical regular pentagons aligned on one side along each great circle path, the dimple pattern is divided in such a manner that its direction is different in the same sequence with respect to each great circle path. Accordingly, the dimples can be arranged equivalently and with good balance on the right and left sides of each great circle path consequently almost same carry (flying distance) can be obtained even when the setting method of the ball is different at the time of hitting. Moreover, because the dimples can be arranged asymmetrically (not symmetrically) on the spherical regular pentagon, limitation on the dimple design can be eased drastically, and freedom of design of the dimple arrangement becomes high.

In the case of the golf ball whose spherical surface is divided in a manner corresponding the facets of the cubic octahedron, the dimple arrangements are different from each other when viewed from the direction of each side of the spherical regular triangles. Three of these spherical regular triangles are aligned along one side of each great circle path such that each of the three is oriented differently from the other two with respect to each great circle path. The same sequence of triangle orientation is followed along all of the great circle paths. Accordingly, design freedom of the dimple arrangement can be improved while securing nearly the same carry even when the setting method of the ball is different, in the same way as described above.

DESCRIPTION OF THE PREFERRED EMBODIMENTS

Figure 1:
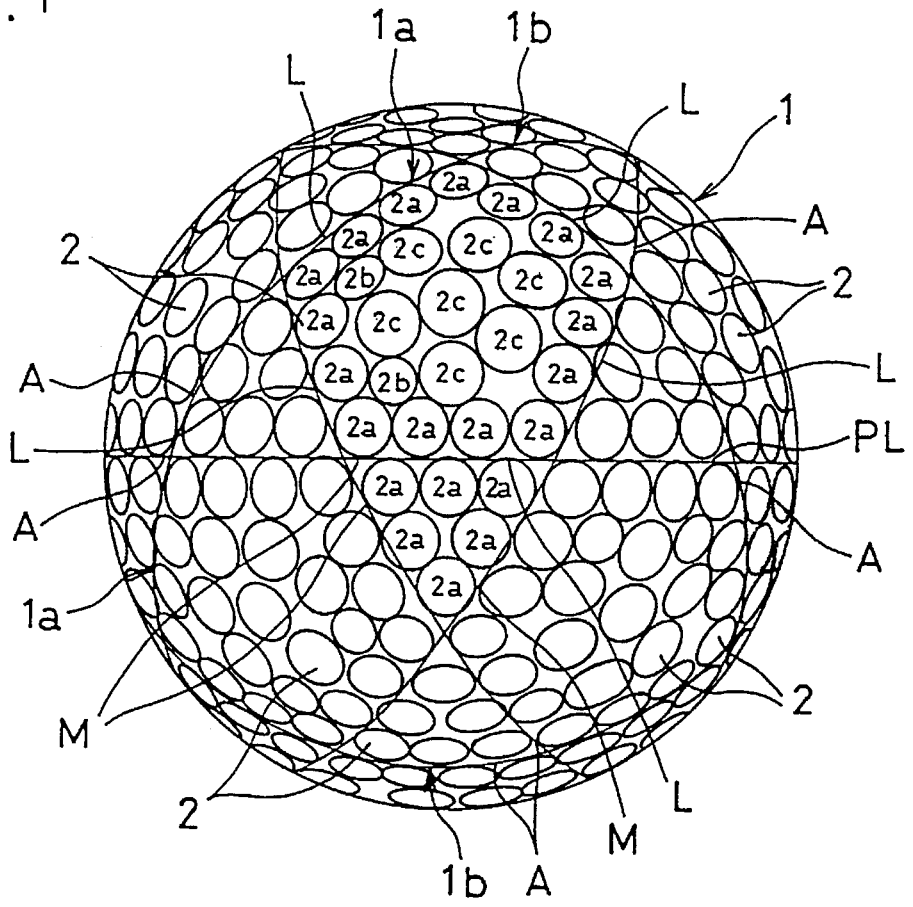
FIG. 1 is a front view showing an example of a golf ball according to the present invention.

FIG. 1 shows an example of a golf ball according to the present invention when a polyhedron inscribing a sphere is assumed to be a dodeca-icosahedron (12–20 hedron). The spherical surface 1 of the golf ball is divided into twelve spherical regular pentagons 1*a* and twenty spherical regular triangles 1*b* corresponding to the facets of the 12–20 hedron. A plurality of dimples 2 are arranged in each of these spherical regular pentagons 1*a* and spherical regular triangles 1*b*. Lines for dividing the spherical surface 1 into the spherical regular pentagons 1*a* and the spherical regular triangles 1*b* coincide with great circle paths A, the center of which coincides with the spherical center of the golf ball. Six great circle paths A in all are disposed on the spherical surface 1. One of these six great circle paths describes a parting line PL corresponding to the seam of upper and lower molds.

Twenty four dimples in total, including three kinds of dimples 2*a*, 2*b*, 2*c* having mutually different diameters are disposed inside each spherical regular pentagon 1*a*. In each of the dimple patterns shown in FIG. 1, four dimples 2*a* having the same diameter are disposed along each side of the spherical regular pentagon 1*a* (15 dimples, in total, because they overlap at angles). Just inside dimples 2*a*, there are provided two equally sized dimples 2*b* each having diameters smaller than those of dimples 2*a* and six equally sized dimples 2*c*, having diameters greater than those of the dimple 2*a*. One additional dimple 2*c* is disposed in the inmost position so that each surface of the spherical regular pentagons 1*a* is filled with dimples. All the dimple arrangements are mutually different when viewed from the direction of each side L of the spherical regular pentagon 1*a*. In other words, the dimple patterns of pentagons 1 are asymmetrical, containing essentially five different dimple patterns, one associated with each side L of the pentagon 1*a*. Each of the 12 pentagons share the same asymmetry. As each pentagon is viewed from the direction of each side L, the side dimple pattern changes from the viewer's perspective.

Each great circle path A is defined by a series of pentagons 1*a* aligned along one side of each path and having sides L that coincide with the path. Five spherical regular pentagons 1*a* are aligned on one side along each great circle path A, so that each great circle path is bounded by five different side patterns. The dimple patterns described above are arranged in such a A sequence of side patterns along each great circle path A is the same.

The same dimple pattern comprising six dimples 2*a* is disposed in each of the spherical regular triangles 1*b*. This dimple pattern is arranged in such a fashion that three dimples 2*a* are disposed along each side M of the spherical regular triangle 1*b* and a part of each dimple 2*a* at an intermediate portion of the two sides is positioned inside the spherical regular pentagon 1*a* beyond the great circle path A excluding the parting line PL. The dimple pattern is symmetric with respect to the perpendicular to the opposing side drawn from the apex of the spherical regular triangle 1*b*, with which the two sides described above keep contact.

In this golf ball 408 dimples, in total, are disposed on the spherical surface 1. These dimples 2 include 300 dimples 2*a* having the intermediate diameter, 24 dimples 2*b* having the smaller diameter and 84 dimples 2*c* having the greater diameter.

Figure 2:
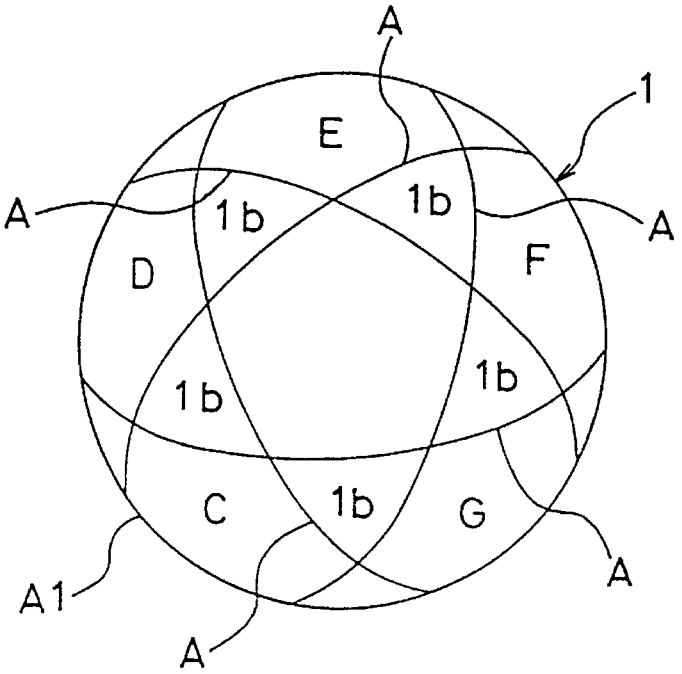
FIG. 2 is an explanatory view useful for explaining a method of arranging dimples shown in FIG. 1.

These dimples 2 can be arranged in the following way (see FIG. 2).

① First, the dimples 2*a* are arranged in each spherical regular triangles 1*b*.

② Next, a dimple pattern as shown in FIG. 1, the dimple arrangements of which are all different when viewed from the direction of each side of the spherical regular pentagon C, is disposed in one spherical regular pentagon C.

③ One great circle path A1 with which the spherical regular pentagon C is in contact is selected, and the dimple patterns are disposed in the following way in four spherical regular pentagons D, E, F, G (except the spherical regular pentagon C) of the five spherical regular pentagons in contact with one side of the selected great circle path A1.

(a) The dimple pattern is disposed in the second spherical regular pentagon D adjacent to the spherical regular pentagon C to have a dimple orientation that is rotated clockwise by 72° relative to pentagon C. Thus, the side of pentagon C that borders great circle A1, has a dimple arrangement that differs from the side of pentagon D bordering great circle A1.

(b) The dimple pattern is then disposed in the third spherical regular pentagon E adjacent to the spherical regular pentagon D, pentagon E having a dimple orientation rotated clockwise by 288° relative to Pentagon C.

(c) The dimple pattern is disposed in the fourth spherical regular pentagon F adjacent to the spherical regular pentagon E, pentagon F having a dimple orientation rotated clockwise by 144° relative to Pentagon C.

(d) The dimple pattern is disposed in the fifth spherical regular pentagon G adjacent to the spherical regular pentagon F, pentagon G having a dimple orientation rotated clockwise by 216° relative to pentagon C..

④ The dimple patterns are disposed in all the remaining five spherical regular pentagons on one side of each great circle path are arranged in the same manner and sequence described above, and with the same dimple arrangements shown in FIG. 1.

With the dimple pattern and sequence described above, each dimple pattern is disposed in such a manner that their directions are mutually different in the same sequence with respect to each great circle path A. Therefore, the dimples 2 can be arranged equivalently and with balance on the right and left sides of each great circle path A, so that even when the golf ball is placed in different ways at the time of hitting, nearly the same carry can be secured. Moreover, the dimples need not be disposed symmetrically on each spherical regular pentagon but may be disposed asymmetrically. Therefore, limitations at the time of dimple design can be drastically eased, and design of the dimple arrangement can be made more freely.

In the embodiment of the invention described above, the dimple arrangement is made in the spherical regular triangle 1*b* in such a fashion that part of two dimples 2*a* extends beyond the great circle path A. Alternatively, it is possible to employ the dimple arrangement so that each dimple is disposed completely inside the spherical regular triangle 1*b* and the dimple arrangements of the dimple pattern can be made the same when viewed from the direction of any side M of the spherical regular triangle 1*b*. According to this arrangement, the dimples 2 can be disposed with better balance on the right and left sides of each great circle A.

Figure 3:
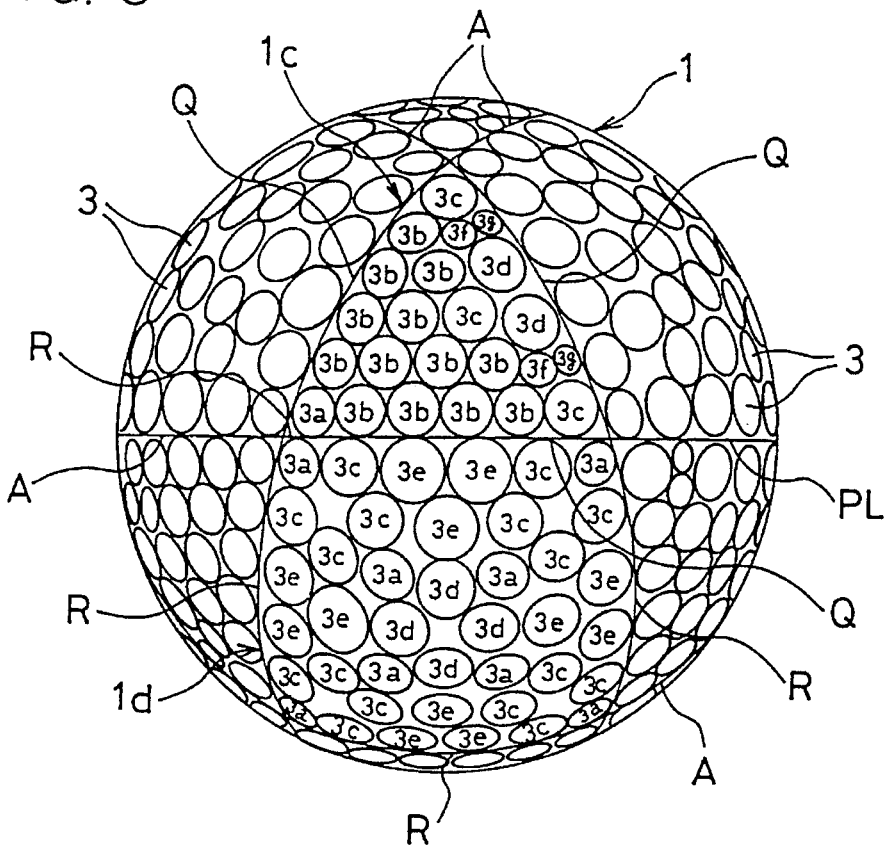
FIG. 3 is a front view showing another example of the golf ball according to the present invention.

FIG. 3 shows another example of the golf ball according to the present invention. In this embodiment, a polyhedron inscribing the sphere is assumed to be a cubic octahedron in arranging dimples.

The spherical surface 1 of the golf ball is divided into eight spherical regular triangles 1*c* and six spherical regular rectangles 1*d* corresponding to the facets of a cubic octahedron, and a plurality of dimples 3 are arranged in each of these spherical regular triangles and spherical regular rectangles. The lines dividing the spherical surface 1 into the spherical regular triangles and the spherical regular rectangles coincide with the great circle path A the center of which coincides with the center of the golf ball, and four, in total, of great circle paths A are disposed on this spherical surface 1. One of these great circle paths is a parting line PL corresponding to the seam of the upper and lower molds.

Dimple patterns having the same dimple arrangement are formed on the spherical regular triangle 1*c*. In the dimple pattern shown in FIG. 3, one dimple 3*a* is disposed at one angle at which two sides Q of the spherical regular triangle cross each other, and four same dimples 3*b* having a greater diameter than that of the dimple 3*a* are disposed along both sides Q. One each dimple 3*c* having a greater diameter than that of the dimple 3*b* is disposed at both angles on the other side Q in such a manner as to continue from the dimples 3*b*. Two dimples 3*d* having a larger diameter than that of the dimple 3*c* are continuously disposed along the other side Q between both angle portions, and one each of two kinds of dimples 3*f* and 3*g* having a smaller diameter than that of the dimple 3*a* are disposed between these dimples 3*d* and dimples 3*c* on both sides so that the dimple 3*f* having the greater diameter is disposed inside. Inner than these five dimples 3*b* and one dimple 3*c* are disposed. The five are disposed along lows of the outer dimples 3*b* described above and the one is disposed between the dimples 3*b* adjacent to the two dimples 3*d* so that each surface of the spherical regular triangles 1*c* is filled with the dimples 3. In the dimple pattern having such dimple arrangements, the dimple arrangements are not the same but are all different when viewed from the direction of each side Q of the spherical regular triangle 1*c*. Twenty-three dimples 3*a*, 3*b*, 3*c*, 3*d*, 3*f*, 3*g*, in total, of six kinds with different diameters are disposed in each of the spherical regular triangles 1*c*, and the dimple patterns are symmetric with respect to the perpendicular to the opposed side drawn from the angle at which the dimple 3*a* is disposed.

When disposed in three spherical regular triangles 1*c* aligned on one side along each great circle path A, the dimple patterns are disposed so that their directions are different in the same sequence with respect to any great circle path A.

In the spherical regular rectangles 1*d*, the same dimple patterns using five kinds of dimples including dimples 3*e* having a greater diameter than that of the dimples 3*d* are disposed in addition to the dimples 3*a*, 3*b*, 3*c*, 3*d* described above. In this dimple pattern, three kinds of dimples 3*a*, 3*c*, 3*e* are disposed along each side R of the spherical regular rectangle 1*d* in such a manner that the dimples 3*e*, 3*e* and 3*c* are interposed in the order named between the dimples 3*a* each disposed at each angle. Inner than these dimples each three dimples are disposed along four lows of the outer dimples, and the dimples 3*e* are interposed between the dimples 3*c* disposed on both sides, respectively. The dimples 3*a* are disposed at the further inner four corners, and four dimples 3*d* are disposed between these dimples 3*a* in such a manner as to fill the remaining spherical surface 1 on which the dimples are not yet disposed. This dimple pattern has a symmetric pattern in the transverse direction such that one each symmetry line can be drawn on a diagonal of the spherical regular rectangle 1*d* and one each symmetry line can be drawn on a line passing the middle point of the opposed sides R of the spherical regular rectangle 1*d*. In total four symmetry lines exists therein. This dimple arrangement has the same arrangement when viewed from the direction of any side R of the spherical regular rectangle. Forty dimples, in total, are disposed inside each spherical regular rectangle, and 424 dimples, in total, are disposed on the spherical surface 1 of the golf ball.

Figure 4:
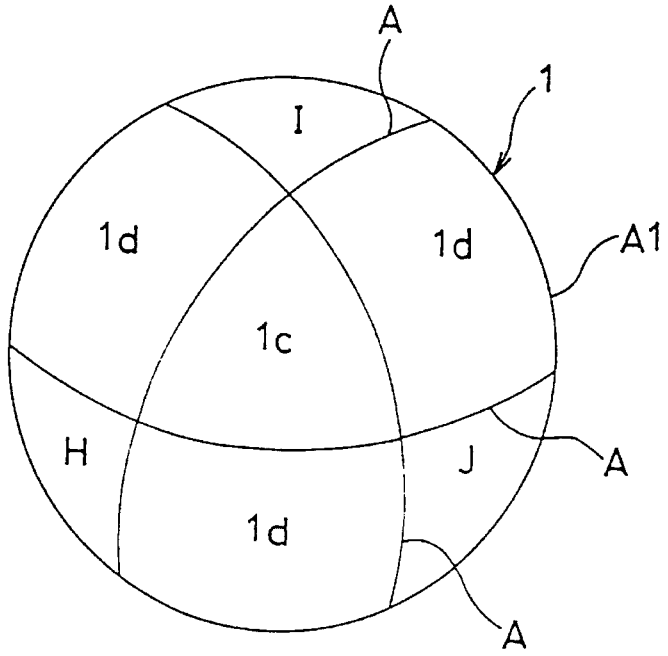
FIG. 4 is an explanatory view useful for explaining a method of arranging the dimples shown in FIG 3.

These dimples 3 can be disposed in the following way (see FIG. 4).

① First, the dimple pattern comprising five kinds of dimples 3*a*, 3*b*, 3*c*, 3*d*, 3*e* described above are formed on each spherical regular rectangle 1*d*.

② Next, a dimple pattern, wherein the dimple arrangements are all different when viewed from any side Q of one spherical regular triangle, are disposed on the spherical regular triangle H.

③ One great circle path A1, with which the spherical regular triangle H is in contact, is selected, and the dimple patterns are disposed in the following way in two spherical regular triangles I, J of the three spherical regular triangles in contact with one side of the selected great circle path A1 (the spherical regular triangle H not included).

(a) The dimple pattern is disposed on the second spherical regular triangle I adjacent to the spherical regular triangle H under the state where the dimple pattern disposed on the spherical regular triangle H is rotated clockwise by 120°.

(b) The dimple pattern is disposed on the third spherical regular triangle J adjacent to the spherical regular triangle I under the state where the dimple pattern disposed on the spherical regular triangle H is rotated clockwise by 240°.

④ The dimple patterns are disposed in the same way as described above on the three spherical regular triangles on one side of each of all the remaining great circle path A by using the dimple patterns, that have already been disposed, as the reference, and the dimples 3 can thus be disposed on the spherical surface 1 as shown in FIG. 3.

Even in the case of the golf ball, wherein the spherical surface 1 is divided into the spherical regular triangles 1*c* and the spherical regular rectangle 1*d* corresponding the facets of a cubic octahedron and the dimples 3 are arranged, the same effect as described above can be obtained by disposing the dimple patterns in such a fashion that their directions are different in the same sequence with respect to each great circle path A when each dimple pattern, the dimple arrangements of which are all different when viewed from the direction of each side Q of the spherical regular triangle, are disposed on the three spherical regular triangles 1*c* aligned on one side along each great circle path A.

EXAMPLE

Figure 6:
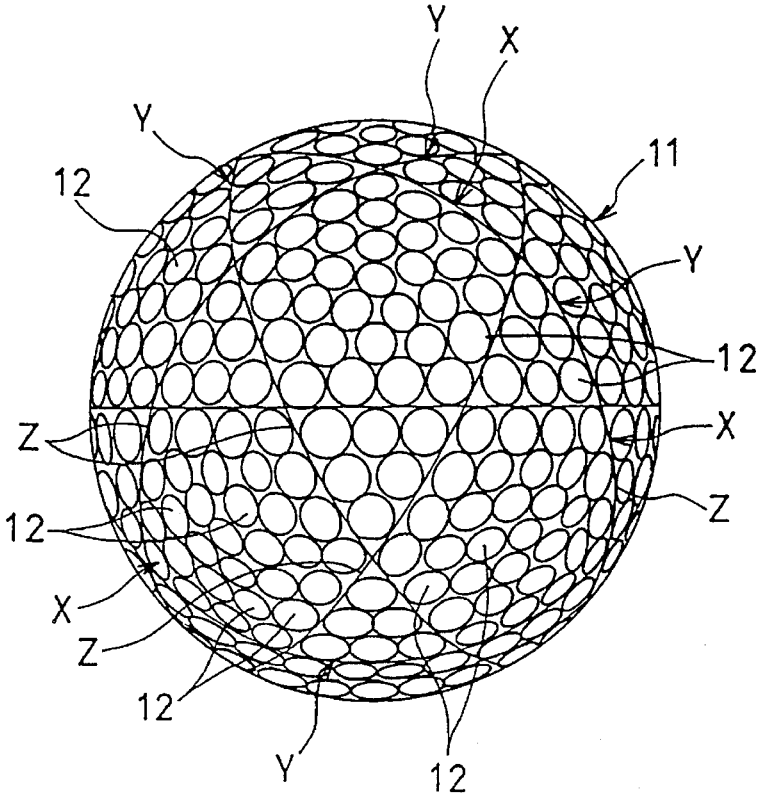
FIG.6 Prior Art
FIG. 6 is a front view showing an example of a golf ball according to the prior art.

The ball of the present invention 1 having the dimple arrangement shown in FIG. 1, the ball of the present invention 2 having the dimple arrangement shown in FIG. 3 and the conventional ball having the dimple arrangement shown in FIG. 6 were produced, respectively. The diameter of the dimples 2*a* in the ball of the present invention 1 is 3.7 mm, the diameter of the dimples 2*b* is 3.2 mm, the diameter of the dimples 2*c* is 4.2 mm, and the area occupying ratio of the dimples to the total area of the spherical surface is 79%. In the ball of the present invention 2, the diameter of the dimples 3*a* is 3.2 mm, the diameter of the dimples 3*b* is 3.5 mm, the diameter of the dimples 3*c* is 3.9 mm, the diameter of the dimples 3*d* is 4.1 mm, the diameter of the dimples 3*e* is 4.4 mm, the diameter of the dimples 3*f* is 2.4 mm, the diameter of the dimples 3*g* is 2.0 mm, and the dimple area occupying ratio is 81%. In the conventional ball, four kinds of dimples having different diameters are disposed. The diameter of those are 4.2 mm, 3.7 mm, 3.5 mm and 3.2 mm, and the dimple area occupying ratio is 82.9%. In total 492 dimples are used.

When the evaluation test of the flying performance of each of these test balls was conducted under the following measurement conditions, the results are tabulated in Table 1.

Flying Performance

Figure 5A:
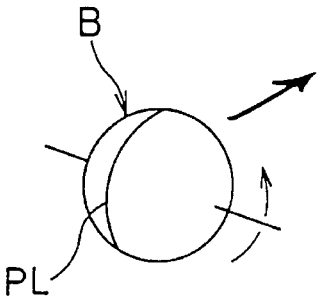
FIG. 5 is an explanatory view of a measurement test of flying property, wherein FIG. 5(*a*) is an explanatory view when a golf ball is placed so that a parting line thereof is perpendicular to the ground surface, and FIG. 5(*b*) is an explanatory view when the golf ball is placed so that the parting line is horizontal to the ground surface.
Figure 5B:
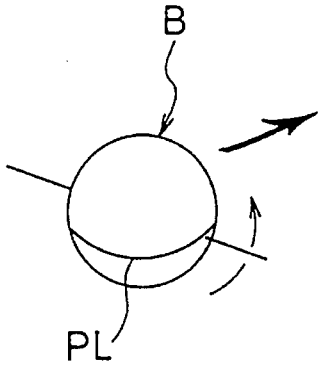

The test balls B were placed so that their parting lines were perpendicular and horizontal to the ground surface as shown in FIGS. 5(*a*) and 5(*b*), respectively, and 10 balls were hit in each case while imparting back-spin rotation as indicated by an arrow by an automatic hitting machine. The carry up to the dropping point of the ball was measured. The carry difference and the flying time difference between the case where the parting line PL was vertical and the case where it was horizontal were measured for each hitting time, and the mean value was evaluated as a percentage of the value of the conventional ball 100. The smaller this numerical value, the smaller difference in carry even when the setting method of the ball is different, and the better becomes the flying performance.

TABLE 1

| | ball of present invention 1 | ball of present invention 2 | conventional ball |
|---|---|---|---|
| carry | 98 | 101 | 100 |
| flying performance | 97 | 99 | 100 |

As can be seen clearly from Table 1, the balls of the present invention 1 and 2 can secure nearly the same carry and the same flying time as the conventional ball even when the setting method of the balls is different.

As described above, in the golf ball the spherical surface of which is divided in such a manner as to correspond to the facets of the dodeca-icosahedrons (12–20 hedrons), the dimple patterns having the same arrangement are disposed in the spherical regular pentagons, each dimple pattern is constituted in such a fashion that the dimple arrangements are all different when viewed from the direction of each side of the spherical regular pentagon and the directions of the dimple patterns disposed in the five spherical regular pentagons aligned on one side along each great circle path are different in the same sequence with respect to each great circle path. And, in the gold ball the spherical surface of which is so divided as to correspond to the facets of the cubic octagons, the dimple patterns having the same arrangement are disposed in the spherical regular triangles, each dimple pattern is constituted in such a fashion that the dimple arrangements are all different when viewed from the direction of each side of the spherical regular triangle, and furthermore, the directions of the dimple patterns disposed in the three spherical regular triangles aligned on one side along each great circle are different in the same sequence with respect to each great circle path. In this way, the present invention can improve design freedom at the time of arrangement of the dimples while securing nearly the same carry even when the setting method of the ball is different for each hitting.

What is claimed is:

1. A golf ball, comprising:

a substantially spherical surface having a plurality of dimples of differing diameter arranged thereon;

twelve spherical regular pentagons and twenty spherical regular triangles arranged on the spherical surface in a manner corresponding to a dodecaicosahedron (12–20 hedron), each pentagon sharing a same asymmetrical dimple pattern thereon, such that an arrangement of dimples extending across the pentagon from each of five sides of each pentagon differs from the arrangement of dimples extending from each of the four other sides thereof, all of the pentagons sharing the same five differing side arrangements; and six great circle paths arranged about the spherical surface, each great circle path being bounded on one side thereof by a series of five adjacent pentagons, one of which is a reference pentagon and the other four of which are respectively and angularly displaced at angles of 72°, 288°, 144° and 216° with respect to the reference pentagon, and wherein a sequence of angular displacement of the series is consistent along all six great circle paths.

2. A golf ball according to claim 1, wherein an outermost row of dimples is arranged along each side of each pentagon, such that each dimple in each outermost row is of a same diameter.

3. A golf ball according to claim 2, wherein each outermost row includes two center dimples and two end-row dimples, each of the end row dimples being located on opposite sides of the two center dimples.

4. A golf ball according to claim 2, wherein the outermost rows of dimples define an outer boundary of each pentagon, and wherein each pentagon includes, within the boundary at least a first kind of dimple having a diameter smaller that the diameter of dimples in the outermost row, and at least a second kind of dimple having a diameter greater than the dimples in the outermost row.

5. A golf ball according to claim 4, wherein all of the dimples with the each pentagon share a single line of symmetry.

6. A golf ball according to claim 4, wherein each pentagon includes two dimples of the first kind and seven dimples of the second kind.

7. A golf ball according to claim 1, wherein three diameter sizes of dimples are disposed within each pentagon.

8. A golf ball according to claim 1, wherein each pentagon shares a similar line of symmetry.

9. A golf ball according to claim 1, wherein dimples associated with each pentagon are completely disposed within each associated pentagon.

10. A golf ball according to claim 1, wherein a dimple arrangement within each spherical reqular triangle is substantially the same as the dimple arrangement in each other spherical regular triangle.

11. A golf ball according to claim 10, wherein dimples are arranged within each spherical regular triangle so that a dimple pattern is the same when viewed from a direction of any side of each spherical regular triangle.

12. A golf ball according to claim 11, wherein each dimple within each spherical regular triangle shares a same diameter.

13. A golf ball, comprising:

a substantially spherical surface having a plurality of dimples of differing diameter arranged thereon;

twelve spherical regular pentagons and twenty spherical regular triangles arranged on the spherical surface in a manner corresponding to a dodecaicosahedron (12–20 hedron), each pentagon sharing a same asymmetrical dimple pattern thereon, such that an arrangement of dimples extending across the pentagon from each of five sides of each pentagon differs from the arrangement of dimples extending from each of the four other sides thereof, all of the pentagons sharing the same five differing side arrangements; and six great circle paths arranged about the spherical surface, each great circle path being bounded on one side thereof by a series of five pentagons each of the five pentagons oriented so that each great circle path is bounded on one side thereof by each of the five differing side arrangements, and wherein a sequence of side arrangements along each great circle path is consistent among all six great circle paths.

* * * * *